1/20/87 XR 4,637,206

United States Patent [19]

Suwa

[11] Patent Number: 4,637,206

[45] Date of Patent: Jan. 20, 1987

[54] FUR-SKIN STRIP MATERIAL AND METHOD FOR PRODUCING THE SAME

[76] Inventor: Teruko Suwa, 20-1, Sendagaya 1-chome,, Shibuya-ku, Tokyo, Japan

[21] Appl. No.: 721,479

[22] Filed: Apr. 9, 1985

[51] Int. Cl.[4] ..... A14B 15/10; D02G 3/06; A41H 41/00

[52] U.S. Cl. ..... 57/31; 28/144; 69/22; 83/915; 219/121 LG; 57/260

[58] Field of Search ..... 57/200, 203, 210, 31, 57/24, 260; 28/144, 159; 26/1; 69/22; 83/22, 53, 83, 374, 451, 452, 915, 926 R, 926 A; 219/121 LG, 121 LN

[56] References Cited

U.S. PATENT DOCUMENTS

| | | | |
|---|---|---|---|
| 1,119,120 | 12/1914 | Salzberger | 28/144 X |
| 2,174,603 | 10/1939 | Settel | 83/915 X |
| 2,573,292 | 10/1951 | Yost | 69/22 X |
| 3,748,212 | 7/1973 | Piampiano et al. | 83/915 X |
| 4,039,799 | 8/1977 | Stumpf | 219/121 LG |
| 4,312,254 | 1/1982 | Pearl | 83/451 X |
| 4,336,439 | 6/1982 | Sasnett et al. | 219/121 LH |
| 4,422,285 | 12/1983 | Rol | 57/260 X |

OTHER PUBLICATIONS

Cutting Clothes with Lasers, Schweisheimer, Polytechnish Tidjschrift 26, (1971), No. 23, pp. 898/899.

*Primary Examiner*—Donald Watkins
*Attorney, Agent, or Firm*—Hamilton, Brook, Smith & Reynolds

[57] ABSTRACT

A fur-skin strip material consisting of yarn-like fur-skin strips that are knitted, crochete or woven to form a fabric and the like. The fur-skin strip material is fine, smooth and soft and can be produced in an industrial scale at a lower cost.

The yarn-like fur-skin strip is made by cutting a hairy-coated skin of a fur-bearing animal. The skin will be placed, the fur side down, on a supporting device that has numerous needles so that the leather side of the skin will be made substantially flat, enabling only the leather side of the skin to be applied with a laser beam or water jet and thereby cutting the skin uniformly into fine strips of furry material.

4 Claims, 9 Drawing Figures

FUR-SKIN STRIP MATERIAL AND METHOD FOR PRODUCING THE SAME

BACKGROUND OF THE INVENTION (1) Field of the Invention

The present invention relates to a new type of material, a fur-skin strip material, consisting of yarn-like fur-skin strips that retain the original fur (or hair) of the skin, and to the method for producing the same. The term "fur-skin" used herein means "a hairy-coated skin of a fur-bearing animal".

More specifically, this invention relates to a new material which is made by cutting only the leather side of a fur-skin into elongated yarn-like strips that retain the original fur (or hair) on the cut strips of leather and to the method for producing the same. This new material is suitable for the production of woven fabrics, knitted products, bags, etc.

(2) Description of the Prior Art

Fur-skins have been conventionally used for various products such as clothing, carpeting, decorations and cushions. Depending on the applications, the skins are cut into desired shapes and the cut pieces are either sewn or glued together and made into a final form of products.

Scissors or knives are hitherto used to cut fur-skins into desired shapes. However, since fur-skins have thick fur on the skins (the leather), it is difficult to cut them into the shapes we want or to cut them into extremely thin elongated strips or strands. It is also difficult to make the cut areas smooth and even. Moreover, it is impossible not only to align the fur in the direction we want to cut but also to cut only the skins (the leather portions) without cutting any of the aligned fur (or hair). When the fur-skin is cut into thin strips by conventional cutters, the fur near the cutting line will be cut away at the same time. Thus, we are unable to manufacture fur-skin strips which have uniform and thick fur by machines. Since it is not practical industrially to cut fur-skins into thin elongated strips or strands by hands, no one in the past attempted to get into mass production of the yarn-like fur-skin strips due to these drawbacks.

BRIEF SUMMARY OF THE INVENTION

The present inventor found out through extensive studies that laser beams and water jet could be effectively used to cut fur-skins into thin strips without damaging the furry hair.

When a laser beam or water jet is used, precision cutting of any fur-skins is feasible. The cut areas or sections will be smooth and practically no fur near the cutting line is cut away. If we can cut fur-skins uniformly into fine elongated yarn-like or thread-like strips without cutting any of the fur, the fur-skin strip material made by this method can be used for manufacturing various products with soft natural fur—knitted fabrics and other textile products. This enables us to provide many products which have hitherto never been available in the marketplace.

When the yarn-like fur-skin strips that retain original fur, according to the present invention, are woven or knitted into a fabric, many new products become available in various categories of textile products—knitted products, various types of clothing, carpeting, bags, etc.

It is, therefore, the primary object of the present invention to provide a new yarn-like fur-skin strip material that retains original fur of fine/smooth/soft texture.

Another object of this invention is to provide a fur-skin strip material which can be produced in an industrial scale at a lower cost.

An additional object of this invention is to make the fur-skin strip material available for production of various types of garments, carpeting, cushions, bags and the like.

A further object of this invention is to provide a new method for producing the above-mentioned fur-skin strip material.

According to the present invention, the fur-skin strip material consists of yarn-like fur-skin strips that retain original thick natural fur (or hair) on one side of the strips which material is made by cutting only the leather side of a hairy-coated skin of a fur-bearing animal into strips of 0.3 to 7 mm wide. The fur-skin strips can be twisted or twined. Furthermore, the method for producing the fur-skin strip material comprises the steps of placing a fur-skin on numerous upright needles of a skin holding device such that the fur side of the fur-skin faces downward so as to make the leather side face upward making the surface of the leather side of the fur-skin substantially flat; and applying a laser beam or water jet to the leather side of the fur-skin so that only the leather portion will be cut by the laser beam or water jet.

BRIEF DESCRIPTION OF THE DRAWINGS

These and other objects and features of the present invention will become more apparent from the following description taken in connection with the accompanying drawings, in which.

DETAILED DESCRIPTION OF THE INVENTION

Figure 1:
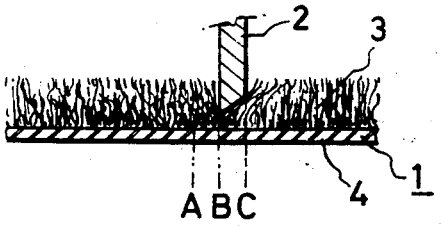
FIG. 1 is a partially enlarged vertical sectional view illustrating a state of cutting a fur-skin with a conventional cutter.

As described above, the fur-skin strip material consists of yarn-like fur-skin strips. Each yarn-like fur-skin strip retains original thick natural fur or hair on one side of the strip since this system allows cutting only the leather of the fur-skin and no fur on the other side of the skin is cut away, and its detailed method is described below.

That is, the method for cutting fur-skins is characterized in that the fur-skin is placed on numerous upright needles planted in the skin holding device making the surface of the leather side of the fur-skin substantially flat. In this state, a laser beam or water jet is applied to the leather side of the fur-skin to cut only the leather portion of the fur-skin. This method will be described in the following, taking an example of the use of a special skin-holding device and the laser beam.

The laser beam used for cutting fur-skins according to the method of this invention is a parallel light beam which has excellent monochromaticity and coherence. The laser beam can be focused on a pinpoint through a focusing lens or by a focusing mirror. Laser beams have been used for optical transmission, information recording, measuring things, cutting or boring of various materials, medical treatments, etc.

According to this invention, a laser beam is applied only on the leather side of the fur-skin. If the laser beam is applied from the fur side of the fur-skin, it will burn and frizzle the fur, reducing the quality of the fur-skin substantially. In order to prevent this and make only the leather side of the skin be irradiated with the laser beams, the fur side of the skin has to be placed downward so that the leather side of the skin faces upward.

However, when a fur-skin is placed on a flat table in this manner, the surface of the leather side of the fur-skin becomes 'rugged' due to uneven lengths, softness and irregular angles of the fur. Because of this rugged surface of the leather side of the skin, the focal point of the laser beam does not often align with the line on which the skin is supposed to be cut. Consequently, undesirable things like "uncut sections" and "burning of the fur" often occur.

In order to solve such problems, the present inventor made various experiments, and she found out that we can prevent those problems if we focus and concentrate the laser beam and its energy only on the leather by keeping the depth of the focal point as small as the thickness of the leather and substantially reducing the laser energy and making the laser beam out of focus when it penetrates the leather and comes out of the fur side of the skin.

When the focal depth of the laser beam becomes small, or when the surface of the leather becomes slightly rugged, the focal point will most likely move away from the line on which the laser beam cuts the skin. For this reason, we must maintain the surface of the leather side of the skin completely flat. To serve this need, the special skin-holding device having numerous upright supporting needles was invented.

A fur-skin will be placed on this skin-holding device with the fur side facing downward so that the leather side will face upward. The fur side sits on numerous needles planted in this device and this makes the leather side completely flat. When the leather side is irradiated with the laser beam, the focal point of the laser beam will stay on a desired cutting line. When the laser beam is irradiated, it is absorbed into the leather on this line and the irradiated area of the leather will burn up, thereby cutting the fur-skin.

The above-mentioned skin-holding device comprises (a) a frame body with the bottom and with the brim that projects inward form the top of side walls, (b) a plate with numerous needles planted inside of the fame body—the distal ends of the needles provide a flat level plane and the height of this plane is aligned with the height of the brim projecting from the top of the four side-walls and the needle plate has numerous small holes where air will be sucked out, and (c) an air vacuumizing unit that makes the air pressure inside of the frame body negative.

The preferred embodiment of the present invention will now be described with reference to the accompanying drawings. In the first place, a typical cutting method of fur-skins according to the conventional art is described for the purpose of comparison.

FIG. 1 is a partially enlarged cross-sectional view illustrating the state of cutting a fur-skin with a conventional cutter blade.

When the blade 2 of a cutter is pressed against the fur-skin 1, the uneven fur 3 of the fur-skin 1 is pushed and bent at the lower end. For this reason it is impossible to cut the leather 4 without cutting the fur 3. The same is true even when the fur-skin 1 is turned over and facing the fur 3 downward. Consequently, when we cut the fur-skin 1 at portions of A, B and C, the resultant fur-skin strips will be left practically with no fur. This tendency becomes more notable as the strip becomes thinner.

Figure 2:
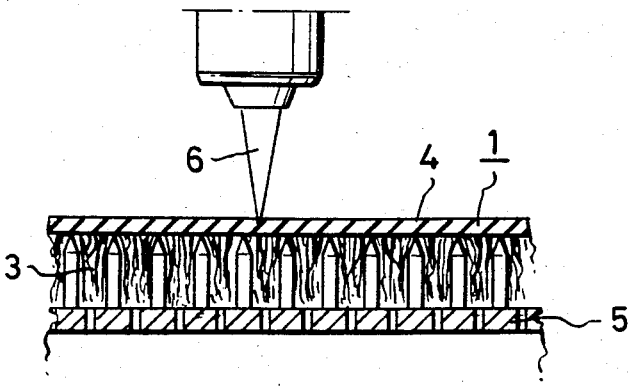
FIG. 2 is a partial enlarged vertical sectional view illustrating a state of cutting a fur-skin by the method of this invention.

According to the present invention, as shown in FIG. 2, the fur-skin 1 is placed on the skin-holding device 5 such that the fur 3 of the fur-skin 1 faces downward and the leather side 4 that faces upward is maintained substantially flat. Then, the laser beam 6 is irradiated only on the leather side of the skin 4 by adjusting the focal point of the laser beam 6 and cuts just the leather portion of the fur-skin.

Figure 3:
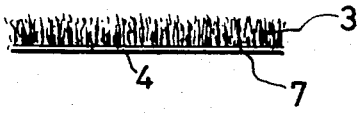
FIG. 3 is a side view of a fur-skin strip of this invention.

With this method, as shown in FIG. 3, the fur-skin strip 7 that grows thick natural fur can be made without losing the fur 3.

Figure 4A:
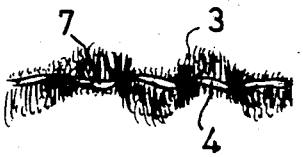
FIG. 4(A) is a side view illustrating a state of a yarn-like fur-skin strip of this invention being lightly twisted.
Figure 4B:
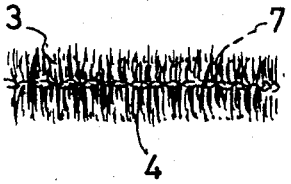
FIG. 4(B) is a side view of a yarn-like fur-skin strip being tightly twisted.

FIG. 4(A) shows the state wherein the fur-skin strip 7 is lightly twisted, and FIG. 4(B) shows the state wherein the fur-skin strip 7 is firmly twisted. Since the yarn-like fur-skin strip of the present invention has thick fur only on one side of the leather, as shown in FIG. 3, when it is lightly twisted, the fur 3 becomes 'helical' as shown in FIG. 4(A). However, when the fur-skin strip 7 is knitted or woven into a fabric, the surface of the fabric will be evenly covered with thick fur. When the fur-skin strip 7 is firmly twisted, as shown in FIG. 4(B), the fur 3 will look as though thickly grown around the leather strip. In addition, it was found out that the firmly twisted fur-skin strip has larger tensile strength as compared with those of untwisted or lightly twisted fur-skin strips. In order to maintain the twisted state of the fur-skin strips, the twisted fur-skin strips are moistened by spraying water on them at the temperature of approx. 35° C. to 40° C. and dried then by streams of circulating air, preferably by hot air of 35° to 60° C.

Various kinds of apparatus may be available to hold the leather side of the fur-skin flat. The following shows a detailed description of the skin-holding device which is determined to be suitable for the purpose of this invention.

Figure 5:
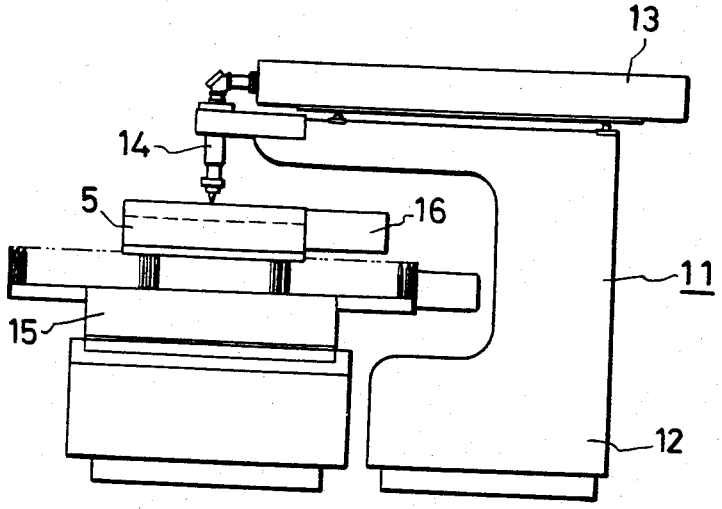
FIG. 5 is a side view of a laser apparatus wherein an exemplar skin-holding device is placed on the X-Y table of the apparatus.

FIG. 5 is a side view of a conventional laser apparatus and upon the X-Y table the skin-holding device 5 is installed.

Referring to FIG. 5, the laser apparatus 11 comprises a frame 12, a laser oscillator 13 installed on the frame 12, a focusing lens unit 14 which is used for laser beam focusing as well as for guiding the laser beam where irradiated therewith, and the X-Y table 15 that holds the object to be cut and moves it horizontally while the laser beam is irradiated.

The skin-holding device 5 is installed on the X-Y table 15. This device 5 shown in the drawing is equipped with a suction box 16.

Figure 6:
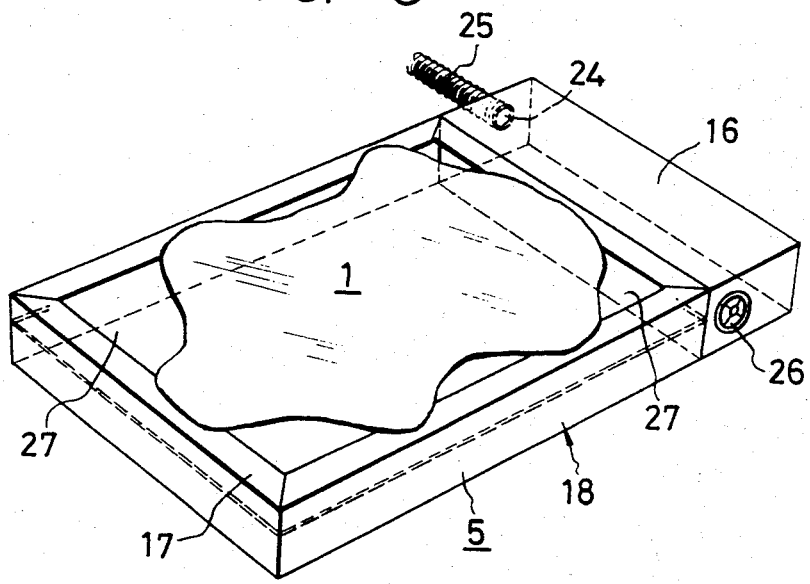
FIG. 6 is a perspective view of the skin-holding device on which fur-skins will be placed.
Figure 1:
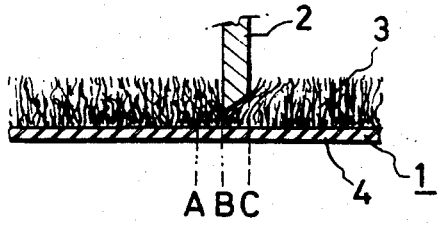
Figure 2:
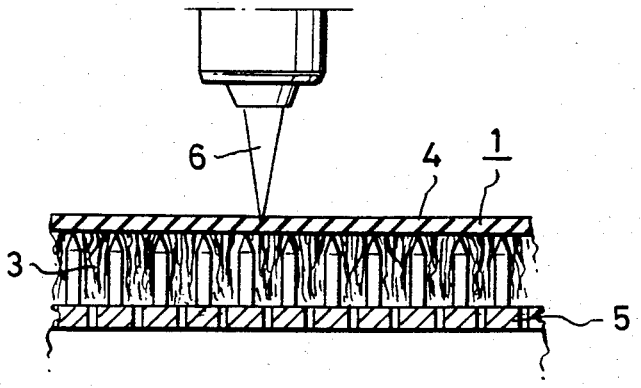
Figure 3:
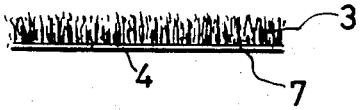
Figure 4A:
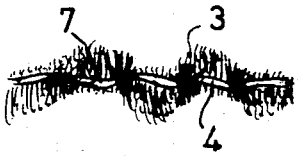
Figure 4B:
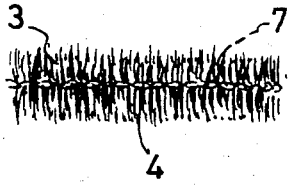
Figure 7:
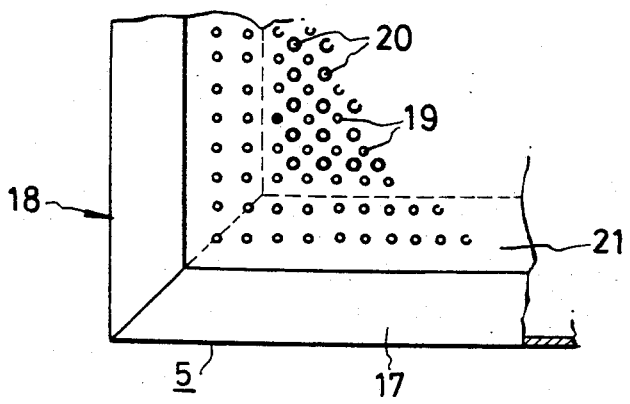
FIG. 7 is a partial plan view of the skin-holding device.
Figure 8:
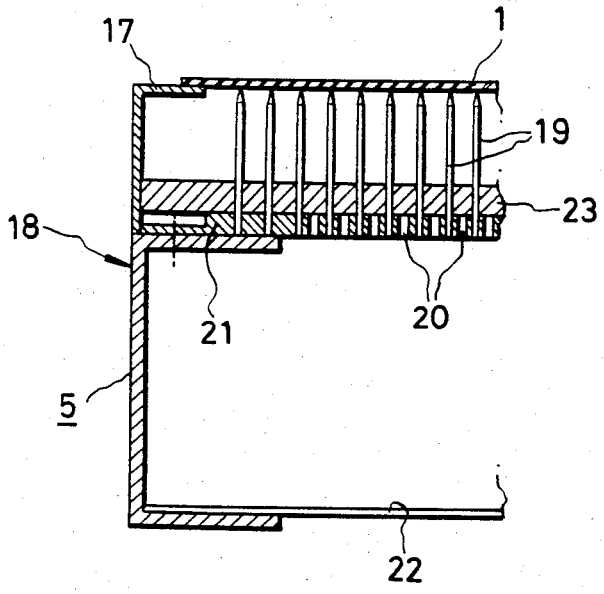
FIG. 8 is a partial vertical sectional view of the skin-holding device.

FIG. 6 is a perspective view wherein the fur-skin 1 is placed on the skin-holding device 5 such that the fur side faces downward. FIG. 7 is a partial plan view of the skin-holding device 5 and FIG. 8 is a partial vertical sectional view of the same device 5. In FIG. 8, the fur 3 grown on the other side of the skin is left out from the illustration.

The skin-holding device 5 comprises a frame body 18 which has the bottom (a bottom plate 22) and the brim 17 projecting inward from the top of the side-walls, and a needle plate 21 (installed inside the frame body 18) that has air holes 20 and numerous needles 19—the distal ends of these needles provide a flat and level plane and the height of this plane is aligned with the height of the brim 17 that projects from the top of the four side-walls.

The brims 17 hold the periphery of the fur-skin 1. The frame 18 is closed at the bottom with the bottom plate 22 so that the interior thereof can be vacuumized by the suction box 16 or by some other devices and thus the inside pressure can be maintained at a negative level.

The needles 19 on the needle plate 21 support the fur-skin 1 from underneath, and when the skin 1 is placed on this skin-holding device 5, the needles 19 go through the fur and contact the leather portion of the fur-skin 1 to directly support the skin, making the other side of the fur-skin (the leather side) as flat as possible. A number of air holes 20 are opened in the needle plate 21 among the needles 19. Through these air holes 19 the air between the needle plate 21 and the fur-skin 1 will be sucked into the frame body by keeping its air pressure negative—making the skin sucked onto the distal ends of the needles to maintain the surface of the other side of the skin (the leather side) as flat as possible. The air sucked through these air holes 20 will get into the suction box 16.

As shown in FIG. 8, the skin-holding device 5 has a filter sheet 23. The filter sheet 23 is made of an air-permeable material such as nonwoven fabric, foamed plastic sheet, rough texture fabric or wire net. The filter sheet 23 serves as a strainer for collecting flocks so that the flocks produced during the laser cutting operation will not clog up the air holes 20 and the suction box 16.

The suction box 16 is connected with the area underneath the needle plate 21 in the frame body 18 and the air goes through the openings (which are not illustrated here) made in the wall between the frame body 18 and the suction box 16. The suction box 16 has an evacuation port 24. A flexible evacuating pipe 25 is mounted on the evacuation port 24 and its distal end is connected to a suction fan or the like to discharge air. Reference numeral 26 denotes a pressure control valve with which the negative pressure inside of this vacuum system is controlled.

When a fur-skin is cut on the skin-holding device described above, the leather side of the fur-skin will be placed face-up, as shown in FIG. 6. Since fur-skins normally do not come in rectangular shapes and usually come in a variety of shapes, open spaces 27 will appear between the skin and the peripheral area of the skin-holding device 5. These open spaces 27 can be closed and sealed tight by covering them with pieces of thick paper, plastic sheet or corrugated cardboard since these pieces of cardboard or plastic sheet will be sucked onto the needles when this holding device is in operation.

The fur-skin 1 is then irradiated with the laser beam in the state shown in FIGS. 2 and 5. For the laser beam 6, we can use ruby laser, Nd glass laser, carbon dioxide gas laser, argon gas laser or the like. The carbon dioxide gas laser which is used here has the oscillation wavelength falling within the infrared region, and because of this, it has a high absorption rate for non-metallic materials as well as high energy conversion rate when compared with other types of laser. Consequently, the carbon dioxide gas laser is suitable for this invention, however; the present invention is not limited to the use of this type of laser.

The irradiation conditions of the laser beam differ depending on the type of fur-skin to be cut. If the leather portion of the fur-skin is 1 to 2 mm thick, a carbon dioxide gas laser of 30 to 50 W can be used and the cutting speed of about 2 to 30 m/min. can be obtained.

A fur-skin can be cut into strips in straight lines or in a whirlpool or helical line. When the fur-skin is cut in a helical line, a relatively long strip of fur-skin is made from a small piece of skin. Therefore, helical cutting is preferable when long strips are needed. The desirable width to which the fur-skins are cut is approximately 0.3 to 7 mm. When the fur-skin strips are too wide, they lose the flexibility and the resultant fabric or knitted products will lose softness and good feel or touch.

When fur-skins are cut by the above method, the leather side of the skins will be cut into thin strips. Since the cutting line can be set freely by the X-Y table 15, very thin and soft strips of fur-skin can be manufactured.

The inventor of the present application has found out that the above-described special skin-holding device can also be employed when a fur-skin is cut into strips by means of a water jet cutting machine. With the water jet, a fine stream of water is blown against the fur-skin held on the bed of needles, at an ultra-high speed and under ultra-high pressure of 20,000 to 35,000 psi or so. Thus, the fur-skin will be cut instantly while the fur (or hair) on the other side is not cut, and consequently, no burning or browning will be observed on the areas where the cutting is done. The stream of jet water goes through a hole opened in the bed of the needle plate with numerous needles so that the skin being cut does not get wet.

Fur-skin strips manufactured by the method of the present invention have not been conventionally available and are expected to be useful for the production of many novel products.

Although the present invention has been described in connection with the preferred example, many variations and modifications will now become apparent to those skilled in the art. It is preferred, therefore, that the present invention be limited not by the specific disclosure herein but only by the appended claims.

What is claimed is:

1. A method for producing narrow, leather strips with fur on one side from animal skins having a leather side and a fur side useful in the production of fur yarns made from twisted fur-skin strips comprising the steps of:

(a) placing a fur-skin on numerous upright needles of a skin holding device such that the fur side of said fur-skin faces downward and the leather side of the fur-skin faces upward so as to make the surface of the leather side substantially flat; and (b) cutting said fur-skin into a plurality of strips by irradiating the leather side of said fur-skin with a moving laser beam under conditions whereby said laser beam cuts the leather of said fur-skin but does not substantially cut fur on the fur-side of said fur-skin.

2. The method according to claim 1, wherein said leather side of the fur-skin is irradiated with the carbon dioxide gas laser beam of 30 to 50 W at the cutting speed of 2 to 30 m/min.

3. A method for producing a fur-skin strip material as in claim 1 wherein said skin holding device comprises:

(a) a frame body having a bottom and brims that project inward from the top edges of sidewalls of said frame body;

(b) a needle plate having a plurality of needles planted inside of said frame body, the distal ends of said needles providing a flat level plane and the height of said needles being aligned with the height of said brim, and said needle plate being provided with numerous small holes where air passes through; and (c) a means for evacuating said unit, thereby holding said fur-skin against said needle plate.

4. A skin-holding device for laser cutting comprising:

(a) a frame body having a bottom and brims that project inward from the top edges of sidewalls of said frame body;

(b) a needle plate having a plurality of needles planted inside of said frame body, the distal ends of said needles providing a flat level plane and the height of said needles being aligned with the height of said brim, and said needle plate being provided with numerous small holes where air passes through; and (c) a means for evacuating said unit thereby holding said fur-skin against said needle plate.

* * * * *